US010174550B2

(12) United States Patent
Cheringal et al.

(10) Patent No.: US 10,174,550 B2
(45) Date of Patent: Jan. 8, 2019

(54) CABLE GUIDED SHADE SYSTEM

(71) Applicant: Lutron Electronics Co., Inc., Coopersburg, PA (US)

(72) Inventors: William Edward Cheringal, Bethlehem, PA (US); Bradley T. Hibshman, Allentown, PA (US); Peter W. Ogden, Jr., Breinigsville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 15/183,324

(22) Filed: Jun. 15, 2016

(65) Prior Publication Data

US 2016/0290039 A1 Oct. 6, 2016

Related U.S. Application Data

(62) Division of application No. 14/169,522, filed on Jan. 31, 2014, now Pat. No. 9,382,756.

(51) Int. Cl.
*E06B 9/327* (2006.01)
*E06B 9/38* (2006.01)
(Continued)

(52) U.S. Cl.
CPC ..... *E06B 9/327* (2013.01); *E06B 9/262* (2013.01); *E06B 9/38* (2013.01); *E06B 9/58* (2013.01);
(Continued)

(58) Field of Classification Search
CPC .... E06B 2009/2625; E06B 9/262; E06B 9/58; E06B 9/326; E06B 2009/583;
(Continued)

(56) References Cited

U.S. PATENT DOCUMENTS 1,169,803 A * 2/1916 Greenberg ..... F16G 11/00 160/277
1,807,769 A 6/1931 Wileman
(Continued)

FOREIGN PATENT DOCUMENTS

EP 2511467 A1 * 10/2012 ..... E06B 9/42
EP 2578792 A1 * 4/2013 ..... E06B 9/266
EP 2927414 A1 * 10/2015 ..... E06B 9/327

OTHER PUBLICATIONS

Lutron, "Cable Guided Roller Shade Install Guide", Lutron Electronics Co., Inc., P/N 045-324 Rev B, 2010, 2 pages.
(Continued)

*Primary Examiner* — Daniel P Cahn
*Assistant Examiner* — Jeremy C Ramsey
(74) *Attorney, Agent, or Firm* — Amy Yanek; Glen Farbanish; Philip Smith

(57) ABSTRACT

A cable guided shade system can include a head rail at least one guide cable anchor spaced from the head rail, and at least on guide cable that is fixed to the head rail and extends to the guide cable anchor. The guide cable anchor is configured such that the guide cable can be tensioned at the guide cabled anchor. The system further includes a covering material that is fixed to the head rail and is configured to move along the guide cable between an open position and a closed position.

5 Claims, 10 Drawing Sheets

(51) Int. Cl.
*E06B 9/262* (2006.01)
*E06B 9/58* (2006.01)
*E06B 9/68* (2006.01)

(52) U.S. Cl.
CPC ..... *E06B 9/68* (2013.01); *E06B 2009/2625* (2013.01); *E06B 2009/2627* (2013.01); *E06B 2009/587* (2013.01); *E06B 2009/6845* (2013.01); *Y10T 29/49895* (2015.01)

(58) Field of Classification Search
CPC .... E06B 9/327; E06B 9/322; E06B 2009/587; Y10T 16/4724; Y10T 16/65; Y10T 24/3969; F16G 11/12
USPC ..... 160/172 R, 172 V, 173 R
See application file for complete search history.

(56) References Cited

U.S. PATENT DOCUMENTS 2,139,950 A * 12/1938 Galley ..... E06B 9/262 160/207
2,654,425 A 10/1953 Hayner
3,721,285 A 3/1973 Debs
3,818,969 A 6/1974 Debs
4,433,713 A 2/1984 Kelly
4,673,018 A 6/1987 Judkins
4,753,281 A 6/1988 Wagner
4,762,159 A * 8/1988 Ford ..... E06B 9/262 160/279
4,776,381 A 10/1988 Riddiford
4,807,683 A * 2/1989 Hennequin ..... E06B 9/32 160/172 R
6,044,889 A 4/2000 Liu
6,283,191 B1 9/2001 Lo
6,796,360 B2 * 9/2004 Ferrie ..... E06B 9/327 160/172 R
7,117,918 B2 10/2006 Franssen
7,730,926 B2 6/2010 Moriya et al.
7,971,625 B2 7/2011 Garmyn
8,056,601 B2 11/2011 Kirby et al.
8,113,264 B2 2/2012 Kirby et al.
8,723,466 B2 5/2014 Chambers et al.
8,857,494 B2 10/2014 Kirby et al.
2012/0261078 A1 10/2012 Adams et al.
2013/0264435 A1 * 10/2013 Chuang ..... A47H 3/02 248/65
2014/0262079 A1 9/2014 Filko
2014/0374038 A1 * 12/2014 Chen ..... E06B 9/324 160/370

OTHER PUBLICATIONS

Lutron, "Cable Guided Roller Shade Install Guide", Lutron Electronics Co., Inc., P/N 045-336 Rev B, 2010, 2 pages.
Lutron, "For Your Information-Cable Guided Shade Fabric Sag Application Note #404", Lutron Electronics Co., Inc., 048-404 Rev A, Feb. 28, 2011, 4 pages.

* cited by examiner

CABLE GUIDED SHADE SYSTEM

CROSS REFERENCE TO RELATED APPLICATIONS

This application is a division of U.S. patent application Ser. No. 14/169,522, filed Jan. 31, 2014, which is hereby incorporated by reference herein in their entireties.

BACKGROUND

Cable guided shade systems can be used to achieve precise shading control by keeping the shade at the exact angle of the window and in applications where unwanted shade motion is to be prevented, for example installations on angled structures (e.g., a skylight) and moving structures (e.g., a door). Cable guided shade systems often include a head rail or roller tube that is mounted proximate to a top end of the window and a pair of guide cables that extend from the housing to a bottom end of the window. A covering material (e.g., a shading material) is then moved along the guide cables between an open position whereby visualization through the window is permitted and a closed position whereby visualization through the window is inhibited. The guide cables maintain the covering material's spacing from the window as the shade is moved along the guide cables. The known cable guided shade systems are difficult to mount. Therefore, a cable guided shade system that is easy to mount is desired.

SUMMARY

Disclosed is a cable guided shade system that is easy to install. In one embodiment, the cable guided shade system includes a head rail configured to be fixed to a structure proximate to a top end of an opening defined by the structure. The system further includes at least one guide cable anchor configured to be attached to the structure proximate to a bottom end of the opening, and at least one guide cable configured to fixed to the head rail and to the guide cable anchor such that the guide cable extends between the top and bottom ends of the opening. The system further includes a covering material that is fixed to the head rail and movable along the guide cable between an open position and a closed position. The guide cable anchor can include an anchor housing that defines a channel and can further include a bracket having a first extension member and a second extension member that is angularly offset with respect to the first extension member. The bracket is configured to have (i) a first position whereby the first extension member is received by the channel such that the guide cable can be pulled through the bracket to thereby tension the guide cable, and (ii) a second position whereby the second extension member is received by the channel after the guide cable has been initially tensioned and fixed to the bracket.

In another embodiment a cable guided shade system can include a head rail configured to be fixed to a structure, at least one guide cable anchor configured to be attached to the structure such that the guide cable anchor is spaced from the head rail along a first direction, and at least one guide cable. The system can further include a plate attached to the guide cable and configured to be attached to the head rail proximate to a bottom end of the head rail and a covering material that is fixed to the head rail and movable along the guide cable between an open position and a closed position. The guide cable is configured to be tensioned at the guide cable anchor after the plate is attached to the head rail.

In another embodiment, an anchor for a motorized cable guided shade system can include an anchor housing and a bracket. The anchor housing can define a cavity and can include a pair of opposed rails that extend into the cavity to thereby define a channel. The bracket can include a first extension member, a second extension member that is angularly offset with respect to the first extension member, and a lock on the second extension member. The second extension member can define at least one aperture that is configured to receive a guide cable. The first extension member is configured to be received by the channel when the guide cable is being tensioned through the at least one aperture, and the second extension member is configured to be received by the channel after the guide cable has been tensioned and fixed to the bracket by the lock, such that the guide cable is further tensioned as the second extension member is being received by the channel.

In another embodiment, a method of mounting a cable guided shade system to a structure can include the steps of mounting a head rail to the structure proximate to a top end of an opening defined by the structure; mounting an anchor housing of at least one guide cable anchor to the structure proximate to a bottom end of the opening; fixing a guide cable to the head rail; tensioning the guide cable at the guide cable anchor by pulling the guide cable through a bracket of the guide cable anchor that is received by the anchor housing; and fixing the guide cable to the bracket.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and systems shown. In the drawings.

DETAILED DESCRIPTION

Figure 1A:
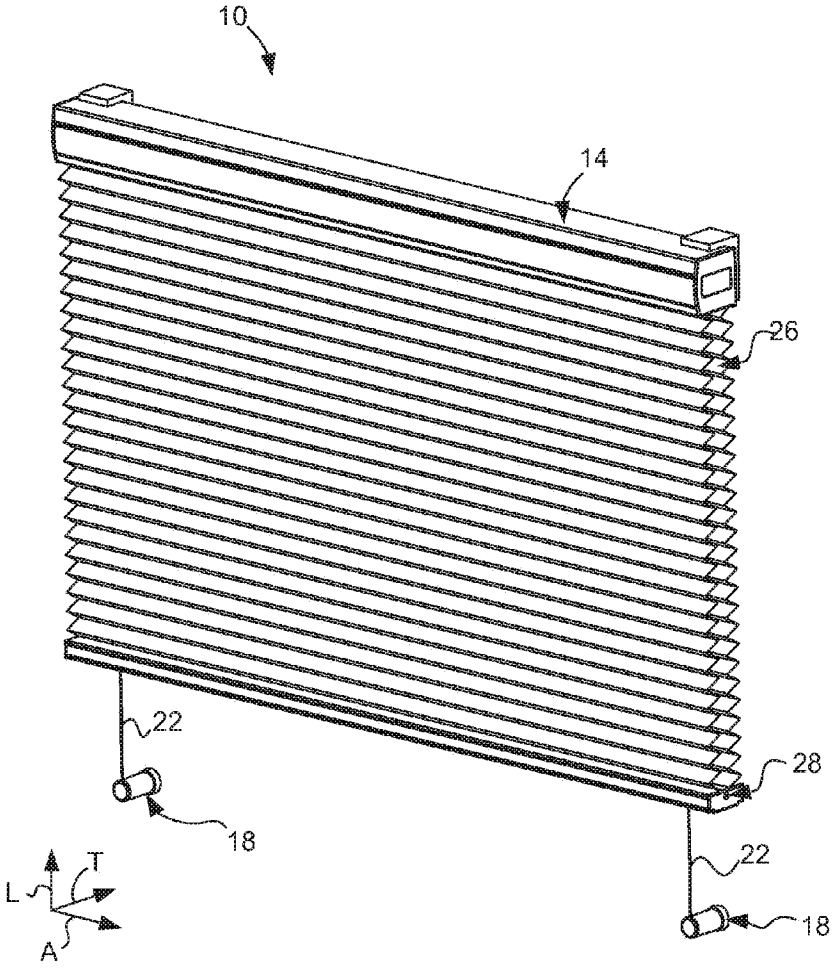
FIG. 1A is a perspective view of a cable guided shade system in accordance with an embodiment, the system including a head rail configured to be mounted above an opening, a pair of guide cable anchors mounted below the opening, a pair of guide cables that extend from the head rail to the guide cable anchors, and a covering material that is coupled to the head rail and movable along the guide cables between an open position and a closed position.

Certain terminology is used in the following description for convenience only and is not limiting. The words "right", "left", "lower" and "upper" designate directions in the drawings to which reference is made. The words "proximally" and "distally" refer to directions toward and away from, respectively, the individual operating the system. The terminology includes the above-listed words, derivatives thereof and words of similar import.

Figure 1C:
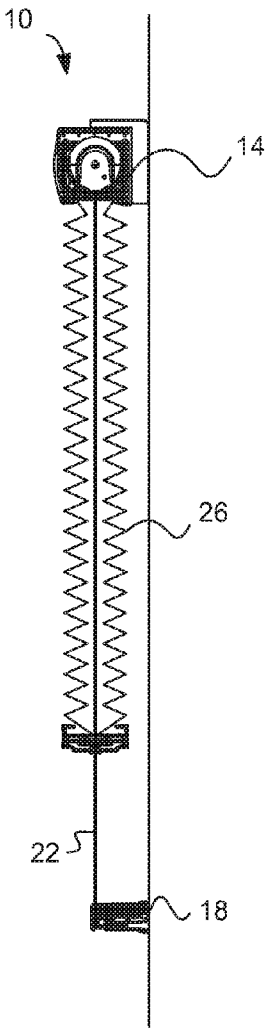
FIG. 1C is a cross-sectional view of the system shown in FIG. 1B through the line 1C-1C.
Figure 1B:
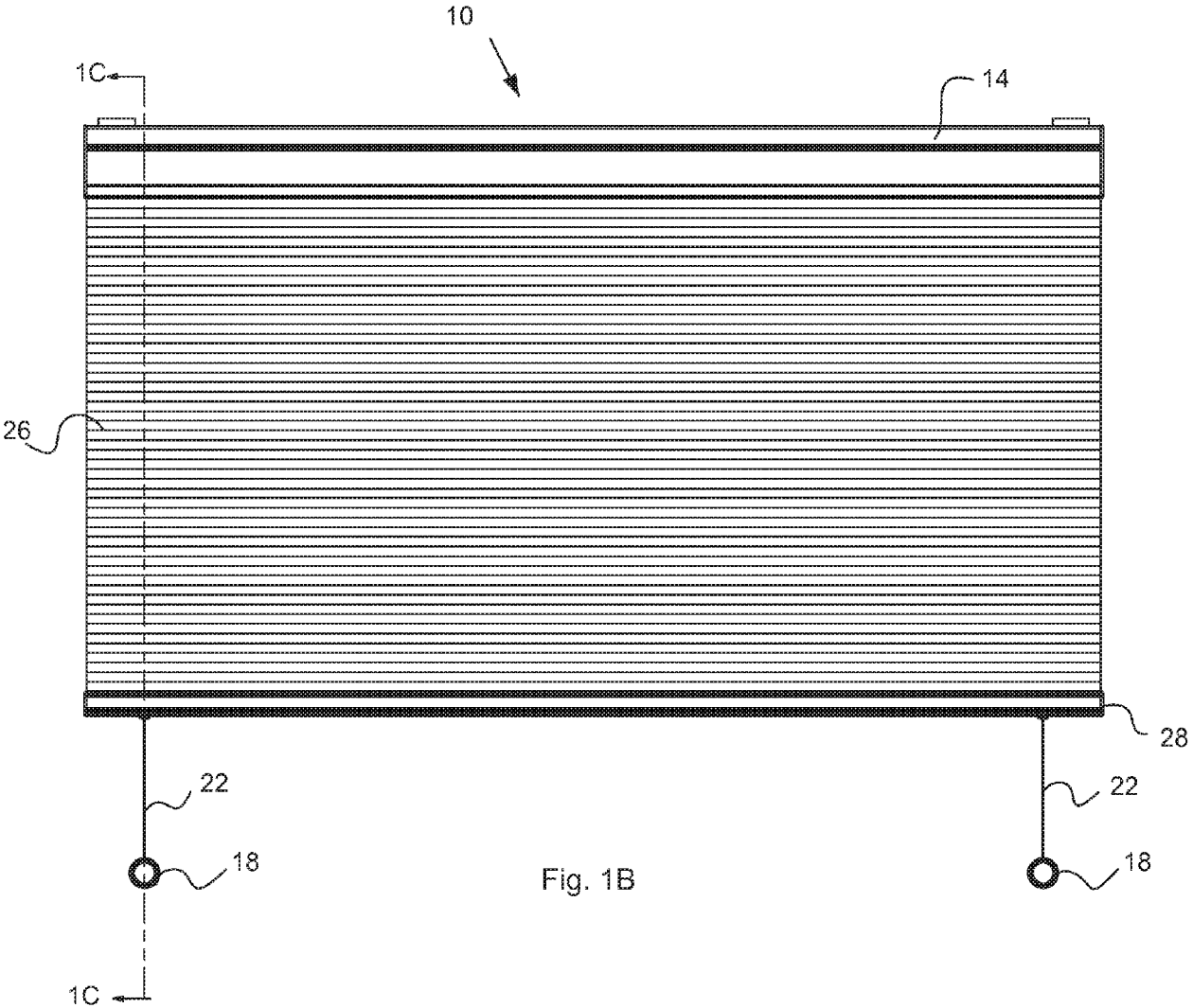
FIG. 1B is a front elevation view of the system shown in FIG. 1A.

Referring to FIGS. 1A-1C, a cable guided shade system 10 includes a head rail 14 that is configured to be coupled to or otherwise mounted to a structure, such as a window frame, wall, or other structure as desired. In particular, the head rail 14 can be configured to be coupled to the structure proximate to a top end of an opening defined by the structure. The opening can be a window or some other space defined by the structure. The system 10 further includes at least one guide cable anchor 18 (such as first and second guide cable anchors 18) that is configured to be fixed to the structure proximate to a bottom end of the opening, and at least one guide cable 22 (such as first and second guide cables 22) that is configured to be fixed to the head rail 14 and to the guide cable anchor 18 such that the guide cable 22 extends between the top and bottom ends of the opening along a first direction L. As shown in FIGS. 1A and 1B, the first and second guide cables 22 are parallel to each other and are on opposed sides of the opening.

The system 10 further includes a covering material 26 (e.g., a shade material or a projection screen) that is fixed to the head rail 14 and is movable along the guide cables 22 between a raised or open position and a lowered or closed position. In particular, the covering material 26 can include a first or top end that is coupled proximate to a bottom end of the head rail 14 and a second or bottom end that is coupled to a bottom bar 28, such that actuation of a drive assembly or other actuator causes the bottom bar 28 to move toward or away from the head rail 14. As shown in FIG. 1A, the guide cables 22 can extend through at least one of the covering material 26 and the bottom bar 28 such that the covering material 26 moves along the guide cables 22. The guide cables 22 are configured to maintain the covering material's spacing from the opening constant. Therefore if the opening is a skylight or a window on a door, the covering material 26 will not fall away from the skylight nor will it move when the door is opened.

The head rail 14 can be made of a metal material, as desired. It should be appreciated, however, that the head rail 14 can be made from any material as desired, or from any combination of materials as desired. It should also be appreciated, that the covering material can be any material as desired. For example, the covering material can be "scrim," woven cloth, non-woven material, light-control film, screen, mesh, cellular, or pleated material. It should further be appreciated that the covering material can be any type of shade as desired. For example, the covering material can be a cellular shade as illustrated, a soft sheer shade, or a projection screen as desired. In addition, the cable guided shade system 10 could comprise a cable guided roller shade system having a roller shade fabric windingly received around a roller tube mounted at the top end of the opening, and a hembar connected to the bottom end of the roller shade fabric and coupled to the guide cables.

The system 10 can be configured as a non-motorized system or as a motorized system. In motorized embodiments, the head rail 14 can include a battery compartment configured to retain a plurality of batteries. The batteries can be configured to power a drive assembly, microprocessor, and/or any other electrical component of the motorized system 10. It should be appreciated, however, that the motorized system 10 can be hard wired, as desired.

In motorized embodiments, the system 10 can include a drive assembly and a control circuit in electrical communication with the drive assembly. For example, the control circuit may comprise a microprocessor and may be mounted to a printed circuit board (PCB). The drive assembly and control circuit can be powered by the batteries. The drive assembly and control circuit are configured to allow for control of the movement of the covering material 26 so that the user can move the covering material 26 along the guide cables 22 to a desired position. The drive assembly can include a sensor arrangement that monitors the position of the covering material 26 so that the control circuit knows the position of the covering material 26 relative to the upper and lower limits of the covering material 26 at any given time. Further, the drive assembly can be manually controlled (e.g. with a push button) and/or wirelessly controlled (e.g. with an infrared (IR) or radio frequency (RF) remote). Therefore, the drive assembly and control circuit may further include an RF transceiver or receiver, and an antenna that may be enclosed within the housing or coupled to an exterior portion of the housing. Examples of drive assemblies for motorized systems such as drive assemblies that are configured to rotate a drive shaft that winds up lift cords are disclosed in U.S. Publication No. 2012/0261078, entitled MOTORIZED WINDOW TREATMENT, the entire contents of which is hereby incorporated by reference herein. It should be appreciated, however, that the drive assembly can be configured to move other types of coverings. For example, the drive assembly can be configured to rotate a roller tube that winds up a roller shade as desired.

Figure 2A:
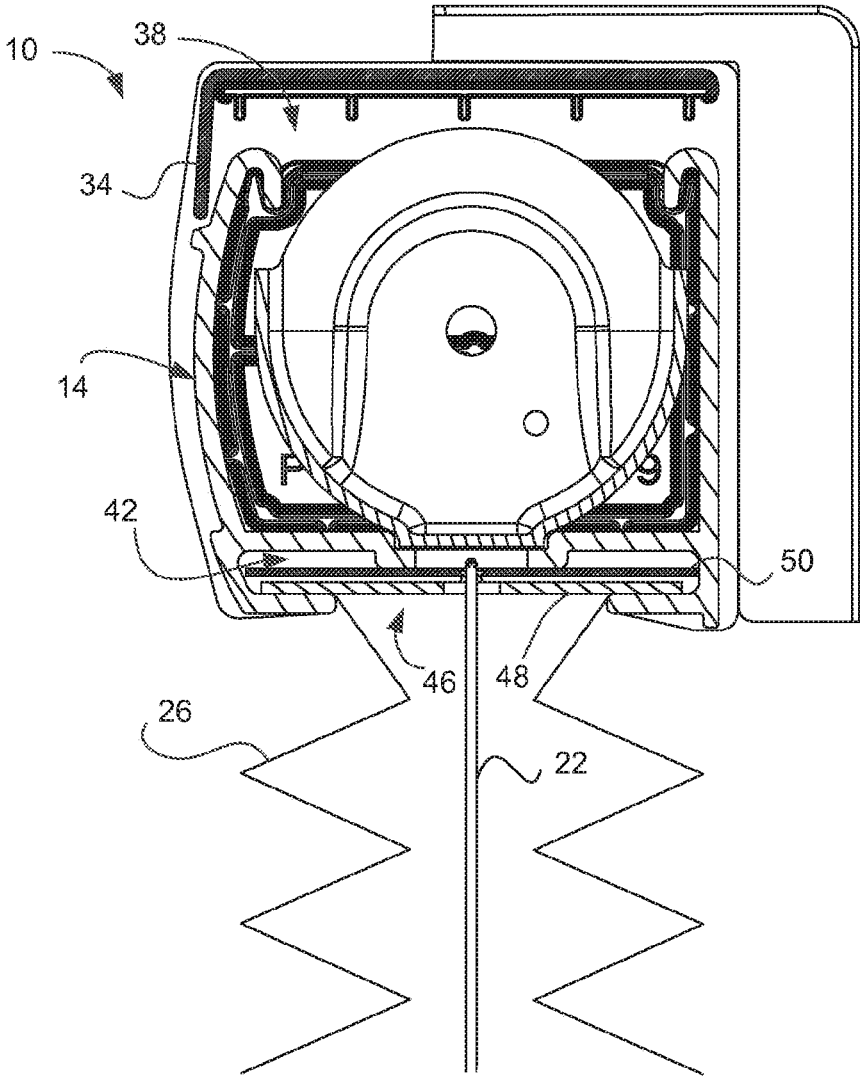
FIG. 2A is a cross-sectional view of the head rail showing a mount that fixes the cable guides to the head rail.

Referring to FIGS. 1A-1C and 2A-2B, the head rail 14 is elongate along a second direction A that is perpendicular to the first direction L and includes a housing 34 that defines a cavity 38 and a slot 42 below the cavity 38. The cavity 38 can be sized to retain any drive shafts, drive assemblies, batteries, and/or other components of the system 10. The slot 42 is elongate along the second direction A and extends through the housing 34 such that the slot 42 defines an opening 46 at its bottom end. As shown in FIG. 2A, the slot 42 is configured to receive a portion 48 of the covering material 26 to thereby fix the covering material 26 to the head rail 14 such that the covering material 26 extends through the opening 46. The portion 48 can be a rigid portion that is connected to the covering material 26. It should be appreciated, however, that in some embodiments the covering material 26 can be coupled to other portions of the system. For example, the covering material 26 can be coupled to a roller tube such that the covering material can be wound about the roller tube as desired.

Figure 2B:
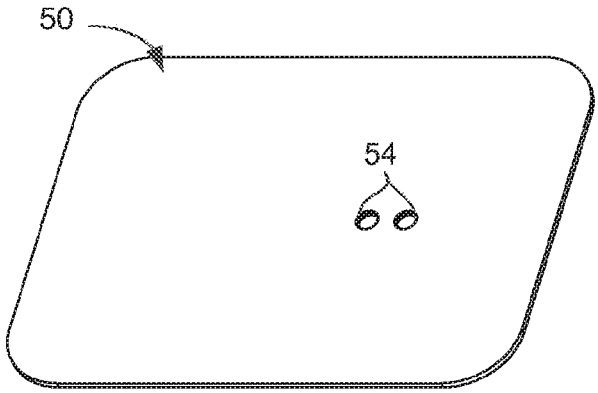
FIG. 2B is a perspective view of the mount for fixing the cable guides to the head rail of FIG. 2A.

With continued reference to FIGS. 2A and 2B, the system 10 further includes a pair of mounts illustrated as plates 50 that are attached to respective guide cables 22. The plates 50 are configured to be attached to the head rail 14 proximate to a bottom end of the head rail 14 to thereby fix the guide cables 22 to the head rail 14. In the illustrated embodiment, the plates 50 are received by the slot 42 such that when the plates 50 are received by the slot 42 the guide cables 22 are fixed to the head rail 14. After the plates 50 and thus the guide cables 22 have been fixed to the head rail 14, the guide cables 22 can be tensioned at the guide cable anchors 18.

As shown in FIG. 2B, the plates 50 can be planar and can define a pair of apertures 54. The apertures 54 of each plate 50 receive one of the guide cables 22 to thereby fix the guide cables 22 to the respective plates 50. It should be appreciated, however, that the plates 50 can have any configuration as desired. Furthermore, it should be appreciated that the guide cables 22 can be fixed to the plates 50 using any structure as desired. For example, the plates 50 can each include a hook that attaches to the respective guide cable 22 as desired.

Figure 3A:
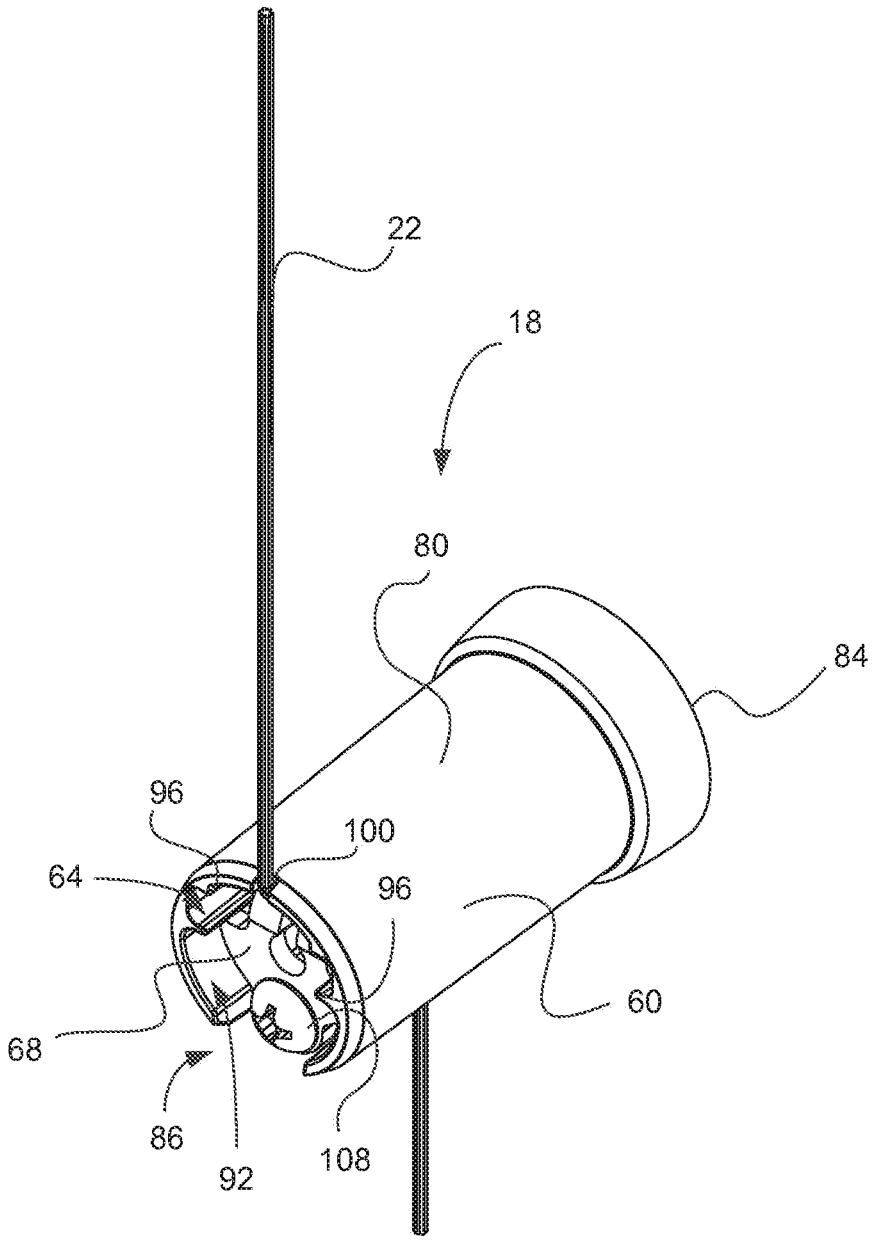
FIG. 3A is a perspective view of the guide cable anchor shown in FIG. 1A, the anchor including an anchor housing and a bracket that attaches to the guide cable and is received by the anchor housing such that the guide cable can be tensioned at the anchor housing.
Figure 3B:
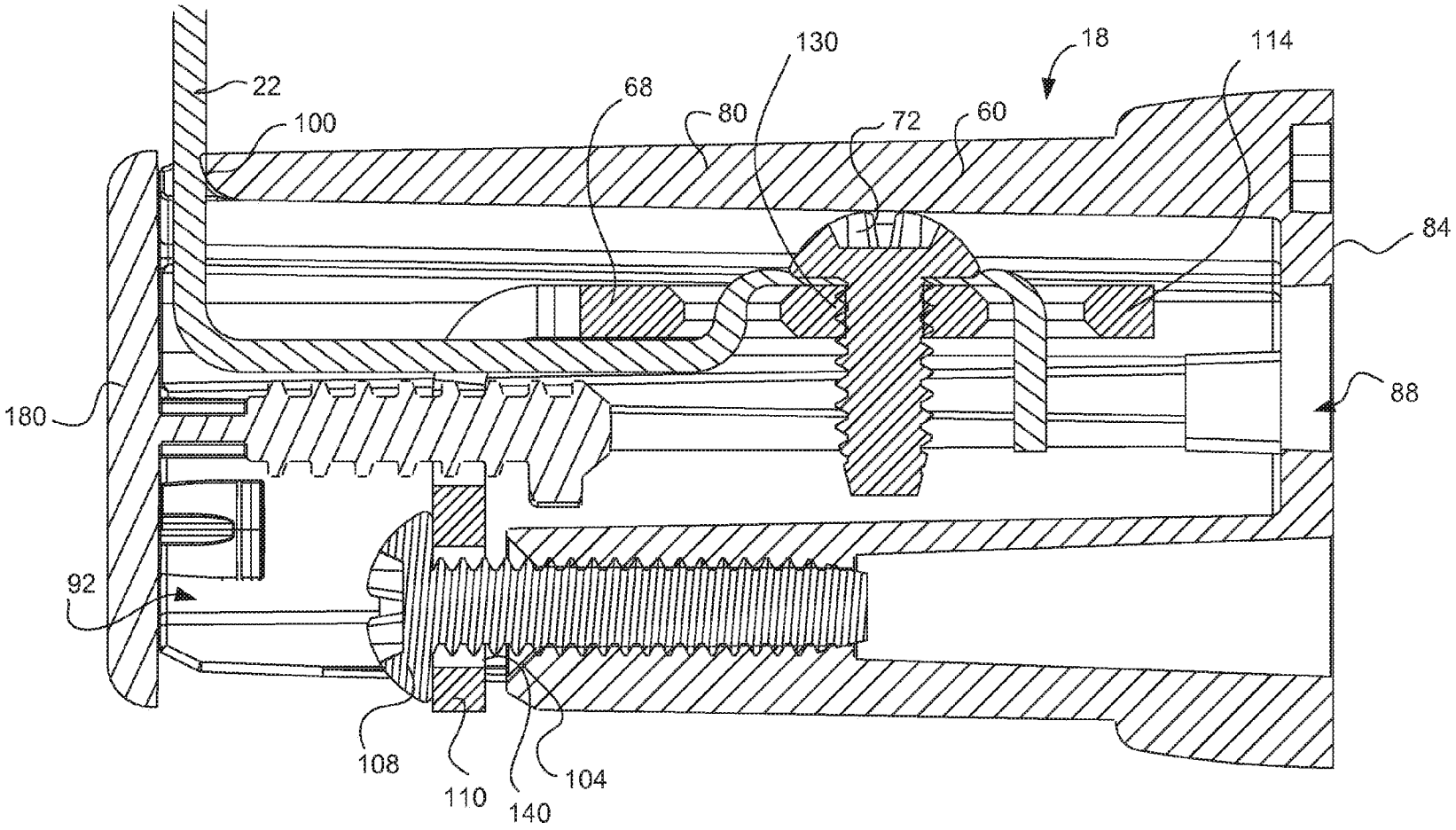
FIG. 3B is a cross-sectional view of one of the guide cable anchors shown in FIG. 3A.

Now referring to FIGS. 3A and 3B, each guide cable anchor 18 is configured to be attached to the structure proximate to the bottom end of the opening defined by the structure. As shown in FIG. 3A, each guide cable anchor 18 includes an anchor housing 60 that defines a channel 64, a bracket 68 configured to be received by the channel 64, and a lock 72 coupled to the bracket 68. The bracket 68 is configured to receive the guide cable 22 such that the guide cable 22 is tensioned at the guide cable anchor 18 and subsequently fixed to the bracket 68 by the lock 72 while the bracket 68 is received by the channel 64. As will be described, the bracket 68 is configured to have a first position whereby the guide cable 22 is initially tensioned and a second position whereby the guide cable 22 is further tensioned and ultimately fixed to the anchor housing 60. The guide cable 22 can be threaded through the bracket 68 prior the bracket being received by the channel 64. It should be appreciated, however, that in some embodiments, the guide cable 22 can be threaded through the bracket after the bracket has been received by the channel 64.

As shown in FIG. 3A, the anchor housing 60 is elongate along a third direction T that is perpendicular to both the first and second directions and includes a housing body 80 having a base 84 and an opening 86 opposite the base 84. As shown in FIG. 3A, the channel 64 receives the bracket 68 through the opening 86 along the third direction T. As shown in FIG. 3B, the base 84 defines at least one elongate aperture 88 that is configured to receive a fastener so as to fasten the anchor housing 60 to the structure. Because the aperture 88 is elongate, the anchor housing 60 can be adjusted (e.g. along the second direction A) after the aperture 88 has received the fastener. It should be appreciated, however, that the anchor housing 60 can include any structure as desired that allows the anchor housing 60 to be fixed to the structure.

With continued reference to FIGS. 3A and 3B, the anchor housing 60 further defines a cavity 92 that is in communication with the opening 86 and extends into the housing body 80 along the third direction T. The cavity 92 is configured to house the bracket 68 when the bracket is received by the channel 64. As shown in FIG. 3A, the anchor housing 60 further includes a pair of opposed rails 96 that extend from the housing body 80 and into the cavity 92 along the second direction A to thereby define the channel 64. As shown in FIG. 3A, the rails 96 are spaced from each other along the second direction A such that when the channel 64 receives the bracket 68, a portion of the bracket 68 moves between the rails 96.

With continued reference to FIGS. 3A and 3B, an end of the anchor housing 60 includes a slot 100 that extends into the housing body 80 along the third direction T above the channel 64. The slot 100 is configured to receive the guide cable 22 when the bracket 68 is slid into the channel 64 and moved to its second position. The slot 100 is configured to recess the guide cable 22 into the housing body when the bracket 68 is fully in its second position. As shown in FIG. 3B, the anchor housing 60 further includes a bore 104 that is configured to receive a fastener 108 when the bracket 68 is in its second position to thereby fix the bracket 68 to the anchor housing 60. In the illustrated embodiment, the bore 104 is below the channel 64, though it should be appreciated, that the bore 104 can be disposed anywhere within the anchor housing 60 relative to the channel 64 as desired.

Figure 4:
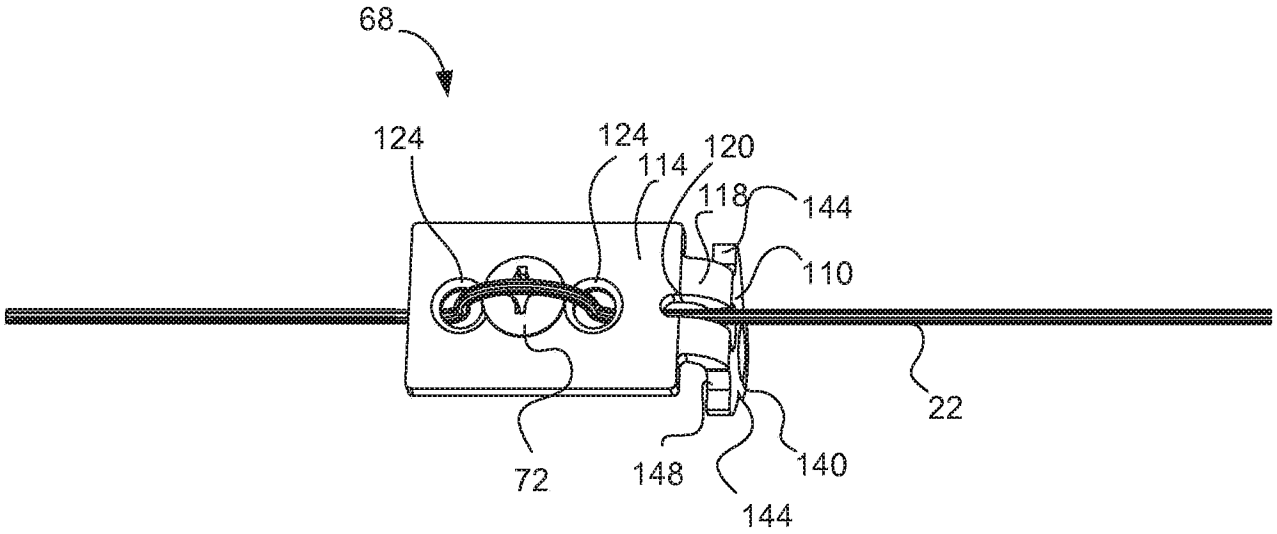
FIG. 4 is a perspective view of the bracket shown in FIG. 3, the bracket having a first extension member and a second extension member that is angularly offset with respect to the first extension member.
Figure 5A:
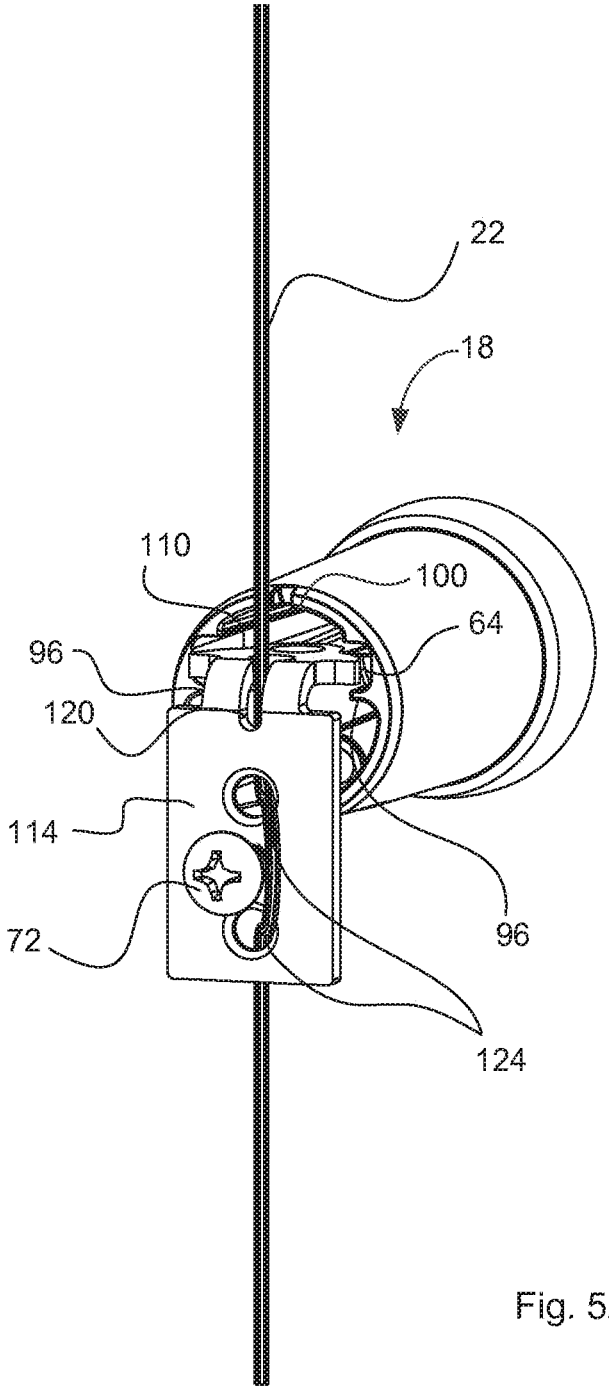
FIG. 5A is a perspective view of the first extension member received in a channel defined by the anchor housing such that the bracket is in a first position whereby the guide cable can be pulled to thereby tension the guide cable.
Figure 5B:
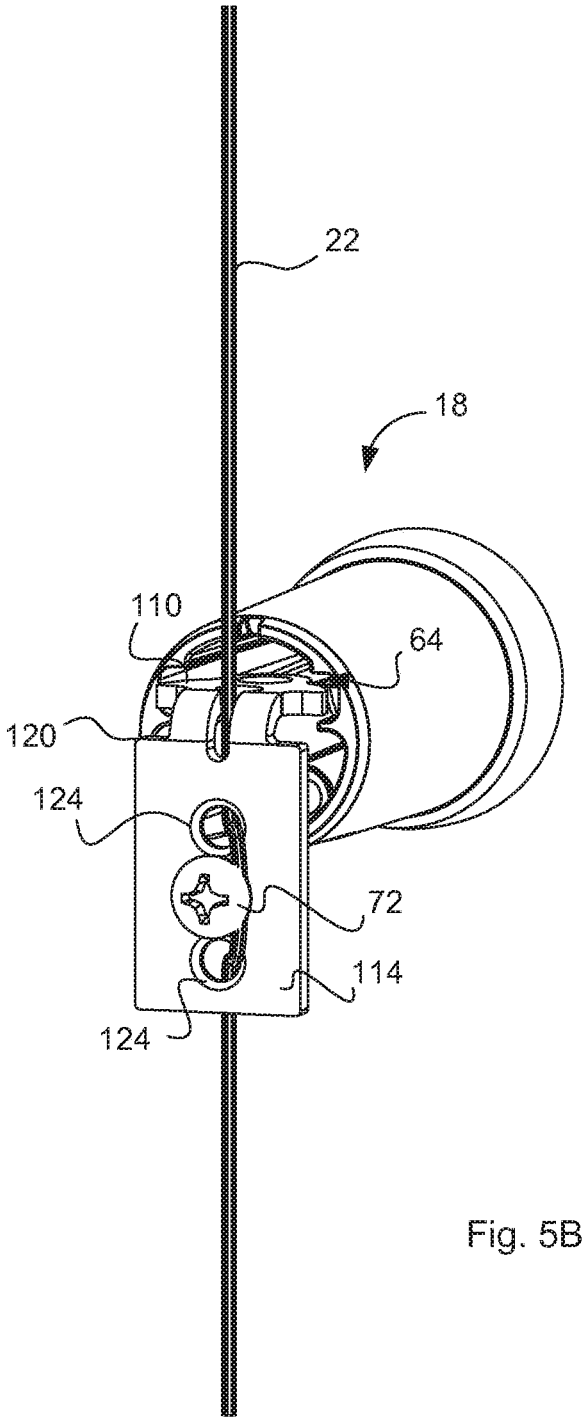
FIG. 5B is a perspective view of the bracket shown in FIG. 5A after the guide cable has been tensioned and fixed to the bracket with a screw.
Figure 5C:
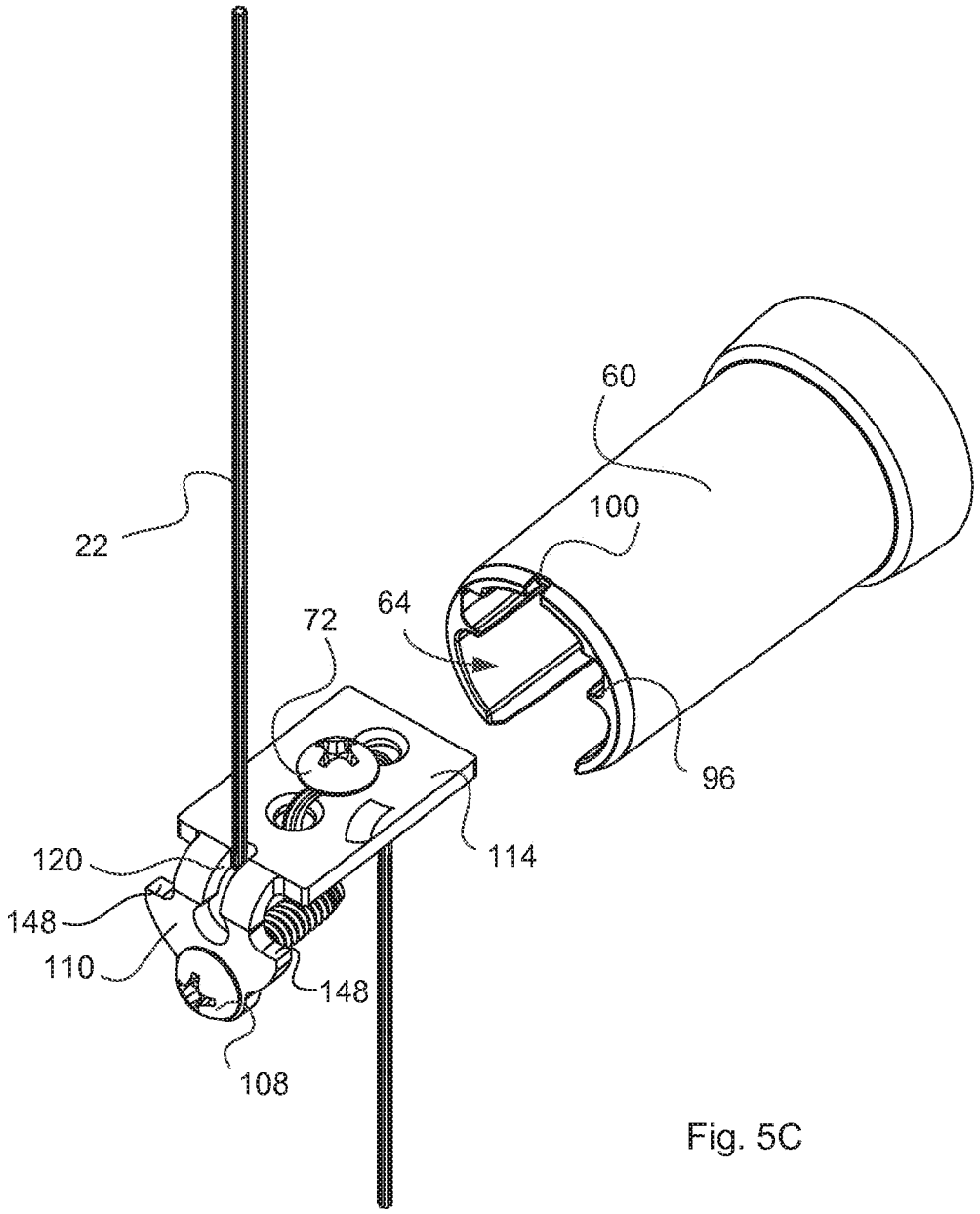
FIG. 5C is a perspective view of the bracket shown in FIG. 5B in a second position whereby the second extension member is configured to be received by the channel of the anchor housing.
Figure 5D:
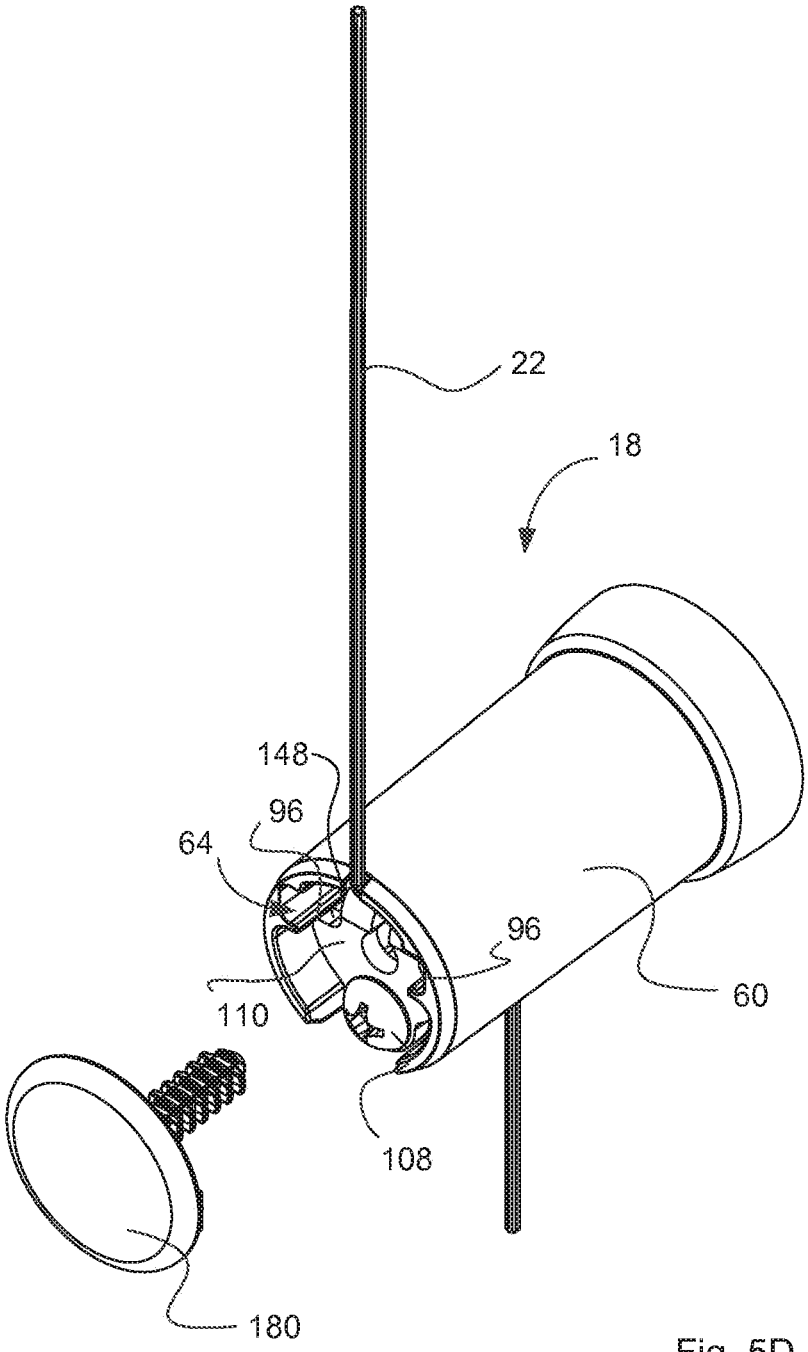
FIG. 5D is a perspective view showing a cap being fixed to the anchor housing to thereby hide the bracket.

Now in reference to FIG. 4, the bracket 68 includes a first extension member 110 and a second extension member 114 that is angularly offset with respect to the first extension member 110. In the illustrated embodiment, the first extension member 110 is substantially perpendicular relative to the second extension member 114 such that the bracket 68 defines an L-shaped bracket. It should be appreciated, however, that the first extension member 110 can extend relative to the second extension member 110 at other angles as desired. When the bracket 68 is in the first position, the first extension member 110 is received by the channel 64 such that the guide cable 22 can be pulled through the bracket 68 to thereby initially tension the guide cable 22 and correctly position the guide cable 22 with respect to the second extension member 114. And after the guide cable 22 has been initially tensioned and fixed to the bracket 68 by the lock 72, the bracket 68 can be moved to the second position whereby the second extension member 114 is received by the channel 64. As the bracket 68 is moved to the second position, the guide cable 22 is further tensioned.

As shown in FIG. 4, the bracket 68 further includes a neck 118 that connects the first extension member 110 to the second extension member 114. The neck 118 is shaped such that when the second extension member 114 is slid along the rails 96 the first extension member 110 moves between the rails 96 without interference from the rails 96. As shown in FIG. 4, the neck defines a slot 120 and the second extension member 114 defines a pair of apertures 124 that are configured to receive the guide cable 22. In the illustrated embodiment, the slot 120 and apertures 124 are aligned such that the guide cable extends through the slot 120 through a first aperture 124 of the pair of apertures 124, around the lock 72, and through a second aperture 124 of the pair of apertures 124. The guide cable 22 can be pulled through the slot 120 and apertures 124 along the first direction L when the first extension member 110 is received by the channel 64 to thereby tension the guide cable 22 and correctly position the guide cable 22 with respect to the second extension member 114. It should be appreciated, however, that in some embodiments the guide cable 22 can be pulled in directions other than the first direction L to tension the guide cable 22, as desired.

With continued reference to FIGS. 3B and 4, the second extension member 114 defines a bore 130 between the apertures 124 and the lock 72 is a screw that mates with the bore 130 such that the screw presses the guide cable 22 against a surface of the second extension member 114 to thereby fix the guide cable 22 to the bracket 68. Therefore after the guide cable 22 has been tensioned by pulling the guide cable 22 downward along the first direction such that the guide cable 22 moves through the slot 120 and apertures 124, the screw can be actuated to thereby fix the guide cable 22 to the bracket 68 such that the guide cable 22 remains in tension. Once the guide cable 22 is fixed to the bracket 68, the bracket 68 can be moved to the second position whereby the second extension member 114 is slid along the rails 96 into the channel 64. Again, as the bracket is being moved to the second position, the guide cable 22 can be further tensioned.

With continued reference to FIG. 4, the first extension member 110 defines a bore 140 that receives the fastener 108 to thereby fix the bracket 68 to the anchor housing 60. That is, the bore 140 aligns with the bore 104 of the anchor housing 60 when the bracket is in the second position such that the fastener 108 extends through the bore 140 and into the bore 104 of the anchor housing 60 to thereby fix the bracket 68 to the anchor housing 60. As shown in FIG. 4, the first extension member 110 further includes a pair of wing members 144 that each defines a respective abutment surface 148 that is configured to abut a bottom surface of a respective one of the rails 96 as the second extension member 114 is being received by the channel 64. The wing members 144 therefore help maintain the guide cable 22 in tension after the second extension member 114 has been received by the channel 64. The wing members 144 are also the portion of the first extension member 110 that ride along the rails 96 when the bracket is moved to the first position whereby the first extension member 110 is received by the channel 64.

It should be appreciated, that the first and second extension members 110 and 114 can have other configurations as desired. For example, the apertures 124, slot 120, and bores 130 and 140 can have other locations on the first and second extension members 110 and 114 as desired. Furthermore, the lock 72 can have other configurations as desired. For example the lock 72 can be configured as a crimp, as desired.

Now in reference to FIGS. 5A-5D, the cable guided shade system 10 can be mounted to the structure by mounting the head rail 14 proximate to a top end of the opening that is defined by the structure. The guide cables 22 can then be fixed to the head rail 14 and the anchor housings 60 can be mounted to the structure proximate to a bottom end of the opening. In particular, the guide cables 22 can be fixed to the head rail by sliding the plates 50 into the slot 42 of the head rail 14. The plates 50 can be slid into the slot 42 either separately or along with a portion of the covering material 26. It should be appreciated, however, that these steps can be performed in any order as desired. For example, the guide cables 22 can be fixed to the head rail 14 either before or after the anchor housings 60 are attached to the structure.

Before the anchor housings 60 are fully fixed to the structure, the anchor housings 60 can be adjusted until the guide cables 22 align with the anchor housings 60 such that the guide cables 22 are parallel to each other. Now the guide cables 22 can be tensioned at the guide cable anchors 18. It should be appreciated, that each guide cable 22 can be tensioned in a similar manner. Therefore, while the tensioning of one guide cable will be described, the second guide cable 22 will be tensioned in a similar manner as the first guide cable 22.

First, the guide cable 22 can be threaded through the bracket 68. That is, the guide cable 22 can be threaded through the slot 120 and apertures 124 of the bracket 68. Once threaded, the first extension member 110 can be slid along the rails 96 and into the channel 64 to thereby move the bracket 68 into its first position. And once the bracket 68 is in the first position, the guide cable 22 can be pulled downward at the guide cable anchor 18 along the first direction L to thereby tension the guide cable 22 and correctly position the guide cable 22 relative to the second extension member 114. The tensioned or otherwise positioned guide cable 22 can then be locked or otherwise fixed to the bracket 68 with the lock 72.

After the guide cable 22 has been tensioned and fixed to the bracket 68, the bracket 68 can be moved to the second position by sliding the second extension member 114 along rails 96 and into the channel 64. As the bracket 68 is being moved into the second position, the guide cable 22 will be further tensioned and will extend through the slot 100 of the anchor housing 60. The guide cable 22 will be further tensioned because of the reorientation of the bracket 68 into the second position. The additional tensioning of the guide cable 22 allows the guide cable 22 to become taut enough such that the covering material 26 can move along the guide cable 22 and maintain its position relative to the structure. Once the bracket 68 is fully in the second position or otherwise fully received within the cavity of the anchor housing 60, the bracket 68 can then be fixed to the anchor housing 60 with the fastener 108. Finally, a cap 180 can be attached to the anchor housing 60 to thereby hide the bracket 68 and trap the guide cable 22 within the slot 100.

While the foregoing description and drawings represent the preferred embodiment of the present invention, it will be understood that various additions, modifications, combinations and/or substitutions may be made therein without departing from the spirit and scope of the invention as defined in the accompanying claims. In particular, it will be clear to those skilled in the art that the invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components, which are particularly adapted to specific environments and operative requirements without departing from the principles of the invention. In addition, features described herein may be used singularly or in combination with other features. For example, features described in connection with one component may be used and/or interchanged with features described in another component. The presently disclosed embodiment is therefore to be considered in all respects as illustrative and not restrictive, the scope of the invention being indicated by the appended claims, and not limited to the foregoing description.

It will be appreciated by those skilled in the art that various modifications and alterations of the invention can be made without departing from the broad scope of the appended claims. Some of these have been discussed above and others will be apparent to those skilled in the art. For example, the cable guided shade system can be configured to move a movie screen between open and closed positions.

What is claimed:

1. A guide cable anchor for a motorized cable guided shade system, the guide cable anchor comprising:

an anchor housing that defines a cavity and includes a pair of opposed rails that extend into the cavity to thereby define a channel; and a bracket that includes a first extension member and a second extension member that is angularly offset with respect to the first extension member, wherein the first extension member and the second extension member are each configured to be inserted in the channel, the bracket positionable in the channel with the first and second extension members in a first orientation when the first extension member is inserted in the channel, and the bracket positionable in the channel with the first and second extension members in a second orientation that is different from the first orientation when the second extension member is inserted in the channel; and a locking mechanism that is coupled to the bracket, wherein the bracket is configured such that:

positioning the bracket in the first orientation enables initial tensioning of a guide cable and securement of the guide cable to the bracket via the locking mechanism; and repositioning the bracket from the first orientation to the second orientation further tensions the guide cable.

2. The guide cable anchor of claim 1, wherein the first extension member is substantially perpendicular to the second extension member.

3. The guide cable anchor of claim 1, wherein the bracket further includes a neck that connects the first extension member to the second extension member, the neck defining a slot and the second extension member defining a pair of apertures, the slot and the pair of apertures configured to receive the guide cable.

4. The anchor of claim 3, wherein the second extension member further defines a bore disposed between the pair of apertures, and wherein the locking mechanism comprises a screw that mates with the bore such that the screw is drivable to press the guide cable against a surface of the second extension member, thereby fixing the guide cable in a position relative to the bracket.

5. The guide cable anchor of claim 4, wherein the second extension member defines the pair of apertures such that the guide cable, when disposed therethrough, is movable during initial tensioning.

* * * * *